US005745960A

United States Patent [19]

Dishner et al.

[11] Patent Number: 5,745,960

[45] Date of Patent: May 5, 1998

[54] ZIPPER APPARATUS AND METHOD FACILITATING MAINTENANCE AND REPAIR

[75] Inventors: Teddy L. Dishner; Terry Breaux, both of Rockport, Me.

[73] Assignee: Walrus, Inc., Seattle, Wash.

[21] Appl. No.: 665,448

[22] Filed: Jun. 18, 1996

[51] Int. Cl.[6] ..... A44B 19/36

[52] U.S. Cl. ..... 24/381; 24/435; 29/426.1; 29/768; 29/408

[58] Field of Search ..... 29/426.1, 426.5, 29/767, 768, 408; 24/381, 387, 388, 408, 403, 433, 434, 435, 436

[56] References Cited

U.S. PATENT DOCUMENTS

| | | | |
|---|---|---|---|
| 3,226,789 | 1/1966 | Burbank . | |
| 3,320,645 | 5/1967 | Burbank . | |
| 3,423,802 | 1/1969 | Hytonen . | |
| 3,889,341 | 6/1975 | Takamatsu | 29/768 X |
| 3,969,794 | 7/1976 | Ebata . | |
| 4,081,882 | 4/1978 | Toepelt et al. . | |
| 4,249,402 | 2/1981 | Steinbach . | |
| 4,350,375 | 9/1982 | Bako . | |
| 4,756,061 | 7/1988 | Jones et al. | 24/435 X |
| 4,821,539 | 4/1989 | Steinbach . | |
| 4,825,514 | 5/1989 | Akeno | 24/387 X |
| 5,301,394 | 4/1994 | Richardson et al. . | |

FOREIGN PATENT DOCUMENTS

| | | | |
|---|---|---|---|
| 252799 | 9/1963 | Australia | 24/436 |
| 2053550 | 5/1972 | Germany | 24/408 |
| 1173019 | 12/1969 | United Kingdom | 24/436 |

*Primary Examiner*—James R. Brittain
*Attorney, Agent, or Firm*—Sheridan Ross

[57] ABSTRACT

A device and method which facilitates the removal of a zipper component such as a slider e.g. for maintenance, repair, security and the like, is provided. In one embodiment a plate configured so that it can define a receiving area is positioned adjacent to a pair of zipper tapes such that a slider may be moved off the zipper tapes and into the receiving area. Preferably the receiving area is configured so that once the slider is in the receiving area it may be removed therefrom and/or a new slider may be inserted therein for positioning onto the zipper tapes. In one embodiment one or more removable doors or tabs are provided to limit movement of the slider and/or prevent movement into the receiving area unless the doors or stop members are moved or removed. In one embodiment, one or more guide lugs are provided for engaging the slider to glide the slider from the receiving area onto the tape so as to readily engage the zipper teeth.

16 Claims, 4 Drawing Sheets

FIG. 4A
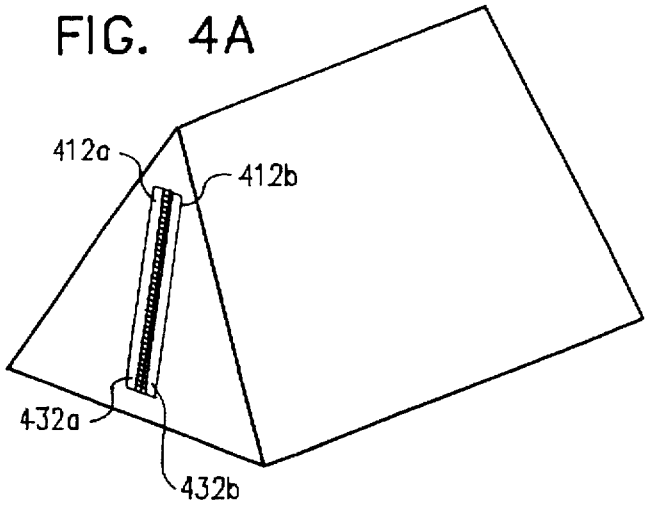
FIG. 3
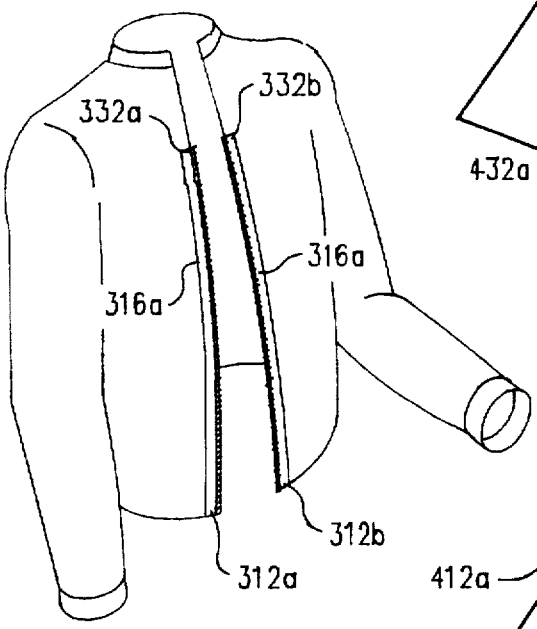
FIG. 4B
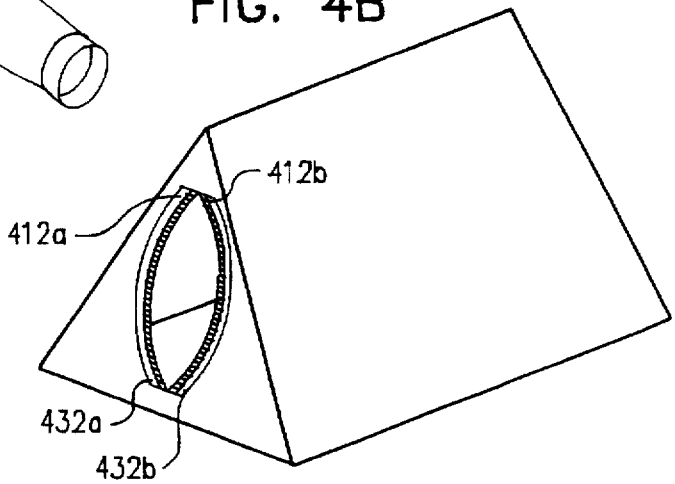
FIG. 8A
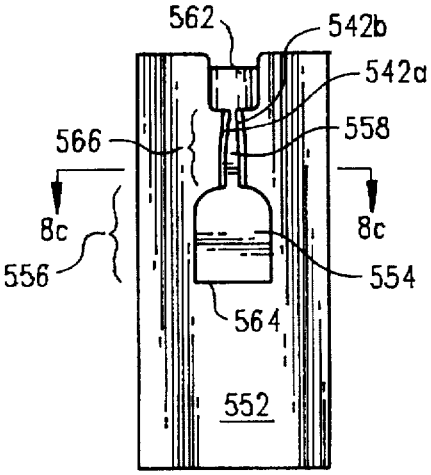
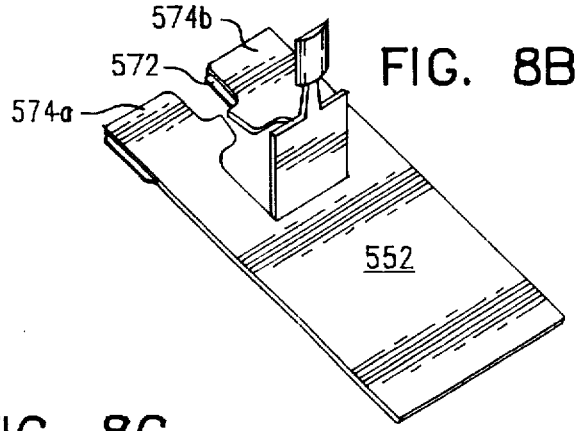
FIG. 8B
FIG. 8C
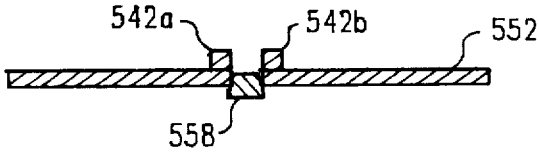

ZIPPER APPARATUS AND METHOD FACILITATING MAINTENANCE AND REPAIR

The present invention relates to a zipper apparatus and method and in particular to an apparatus and method providing an endplate to facilitate repair and maintenance of a zipper.

BACKGROUND INFORMATION

Although many styles of zippers have good durability, it is sometimes desirable to replace or remove certain zipper components, e.g., when a component has become damaged or is approaching its anticipated lifetime. Although in some cases one may remove and replace the entire zipper structure, in others it may be preferable to remove only a single component, such as the zipper slider. One example is zippers which are installed in tents, awnings, backpacks and other camping equipment. In these cases, it has been the practice, in the past, when a zipper has failed or otherwise needs maintenance or repair, to return the entire tent or other such item to a central repair facility for replacement of the entire zipper structure. This procedure has been followed, in the past, even when the only one component such as a slider, needs to be removed. This procedure may lead to undesirably high expenses and an undesirably long maintenance or repair period.

Accordingly, it would be advantageous to provide a zipper and/or zipper component which could facilitate removal or repair of a zipper slider or other component, e.g., such that the component could be easily replaced at a retail level or in the field, without having to remove the entire zipper structure (often meaning removing stitching and then restitching the zipper tapes, typically requiring shipment to a central repair or maintenance facility as noted above). It would further be useful to provide a zipper structure which allows the end user to easily remove and/or replace a zipper component such as a zipper slider.

SUMMARY OF THE INVENTION

The present invention provides a zipper, or component thereof, which can be configured to create a space so that a zipper slider can be moved to position which facilitates removal of the slider, or other zipper component. In one embodiment, an endplate is provided which includes a region which can be configured between a first configuration which retains slider in the normal operating region and a second configuration which defines a region for receiving the slider. Preferably the second configuration defines a slider-receiving area which is configured to permit the slider to be removed, e.g., by an opening. In one embodiment an endplate positioned adjacent to one end of the tapes includes a door normally covering a receiving area sized and shaped to receive the zipper slider. In this embodiment, when the door is opened, the slider may be moved into the receiving area and may be removed from the receiving area so that, e.g., a replacement slider (or a repaired slider) may be inserted into the receiving area and then moved into the ordinary zipper operating region.

BRIEF DESCRIPTION OF THE DRAWINGS

FIG. 3 illustrates an open zipper environment;

FIGS. 4A and 4B are perspective views illustrating an example of a closed zipper environment;

FIGS. 8A and 8B top plan and perspective views of a zipper endplate according to an embodiment of the present invention; and FIG. 8C is a cross-sectional view taken along line 8c—8c of FIG. 8A.

DETAILED DESCRIPTION OF THE PREFERRED EMBODIMENTS

Figure 1:
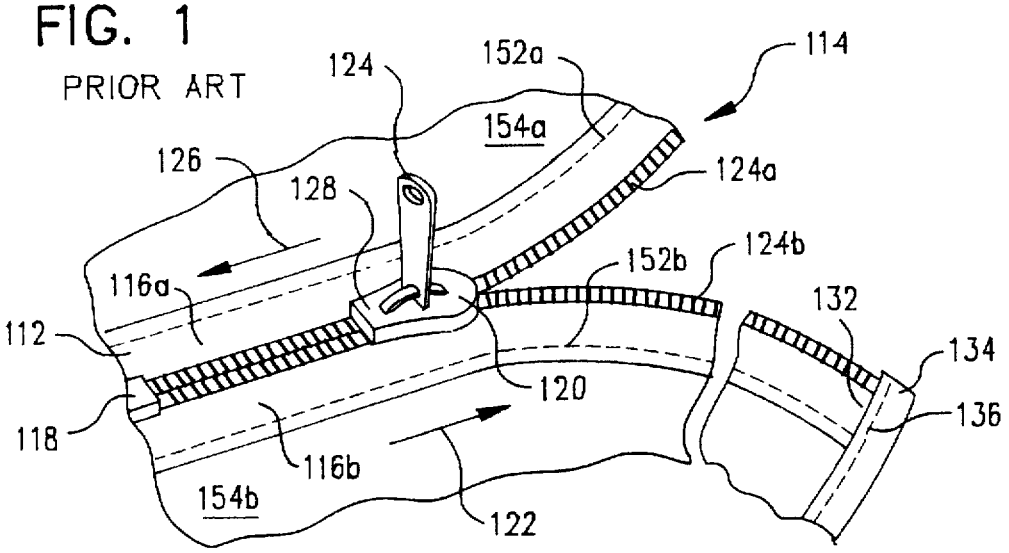
FIG. 1 PRIOR ART
FIG. 1 is a perspective view of a zipper apparatus according to previous devices.

Before describing the details of the present invention and embodiments thereof, it is believed useful to describe certain zipper features in general. FIG. 1 depicts one type of zipper in which a first end 112 of the zipper 114 has first and second tapes 116*a*, 116*b* which are permanently held together by a generally rectangular slider stop 118. Moving the slider 120 in a first zipping direction 122, such as by pulling the tab 124, causes the teeth 124*a*, 124*b* mounted on the tapes 116*a*, 116*b* to engage one another to close the zipper. Moving the slider 120 in zipper second, unzipping direction 126 causes the teeth 124*a*, 124*b* to successively disengage, opening the zipper, until the rear wing 128 of the slider 120 abuts the stop 118. Although many zipper configurations and uses are possible, in a typical configuration, the far end of the zipper tape 132 is provided with a structure to prevent moving the slider 120 past the far end 132, such as a cloth band 134 stitched across the tape end 132 by stitching 136.

Figure 2A:
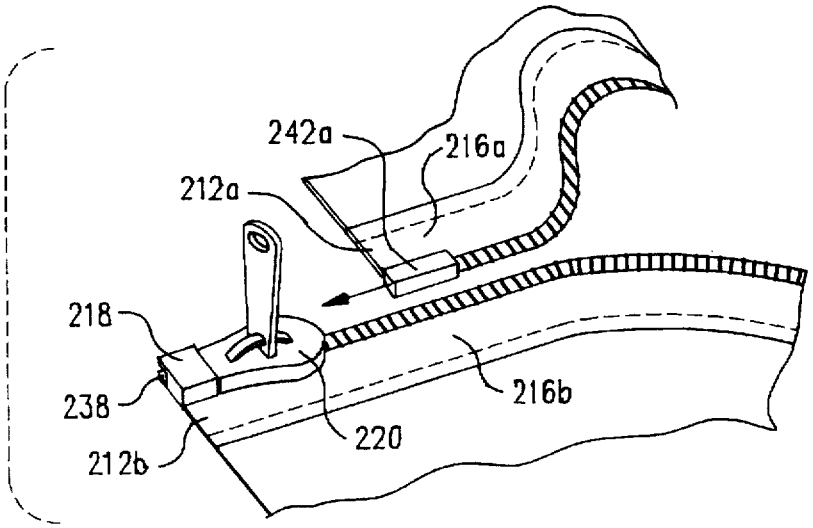
FIG. 2A PRIOR ART
FIGS. 2A and 2B are perspective views of zipper devices according to previous devices.
Figure 2B:
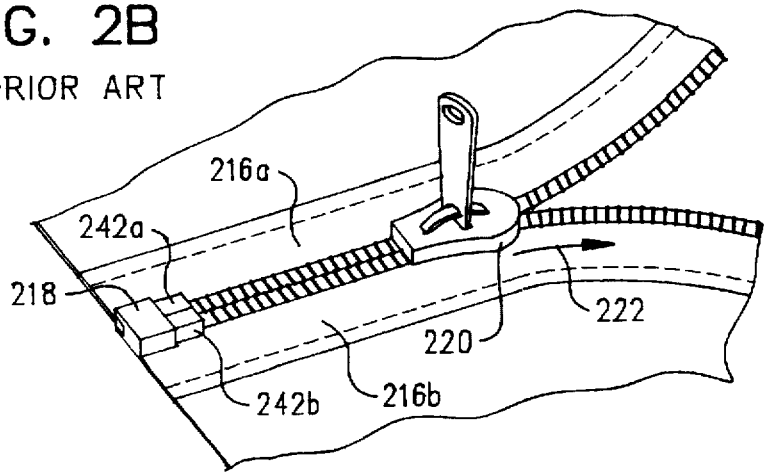
FIG. 2B PRIOR ART

FIG. 2A illustrates another zipper device in which the first ends of the tape 216*a*, 216*b* are not held permanently together. In the example of FIG. 2A, a keeper 218 is attached to the first tape 216*b*, extending slightly outward of the tooth edge of the tape and having a slot 238 or other opening which can be aligned with the track defined by the slider 220 to receive a guide lug 242 attached to the second tape 216*a*. During the time the slider 220 is adjacent and aligned with the keeper 218. After the guide lug 242 has been inserted into the slot 238 of the keeper 218, the slider 220 may be moved in a zipping direction 222 as depicted in FIG. 2B. As shown in FIG. 2B, in a typical configuration, a second fixed lug 242b is configured to extend from the keeper 218 e.g. to position the slider 220 in the desired alignment with the keeper 218 for insertion of the guide lug 242*a*.

The zipper illustrated in FIGS. 2A and 2B will be referred to herein as an open zipper environment which generally refers to an environment such as that depicted in FIG. 3 in which it is possible to disengage the zipper tapes 316*a*, 316*b* from one another and move them away from each other, at least at the first ends thereof 312*a*, 312*b* and, typically, at the far end as well 332*a*, 332*b*. FIGS. 4A and 4B illustrate what will be referred to herein as a closed zipper environment in which at least a first end of the first and second tapes, and typically also the second end, are configured to be permanently adjacent to one another and cannot be moved apart from one another in normal use, whether the zipper is zipped as shown in FIG. 4A or unzipped as shown in FIG. 4B. Although for simplicity of illustration, only a single linear zipper is depicted in FIGS. 4A and 4B, in many typical tent configurations, two or more zippers are provided, e.g., in an inverted T-shape, as will be clear to those of skill in the art.

In any of the configurations depicted in FIGS. 1–4, the slider will be retained adjacent to at least one of the zipper tapes during normal use. For example, in the configuration of FIG. 1, the slider 120 cannot be moved in an unzipping direction 126 past stop 118 nor in a zipping direction 122 past the band 134. Similarly, in the example of FIGS. 2A and 2B (typically used for an open environment as shown in FIG. 3) although the slider 228 may be disengaged from one of the tapes 216*a* (as shown in FIG. 2A) it cannot, in normal use, be disengaged from the other tape 216*b* and is prevented from moving past the first end 212*b* by the keeper 218 and, typically, is prevented from moving past a second end by an end member such as that 134 depicted in FIG. 1.

Because, in the environments of FIGS. 1–2, the slider 220 cannot be readily removed from both tapes, maintenance or repair requirements, such as might result from a damaged or worn slider, typically involved removing the entire zipper structure such as by removing stitching 152*a*, 152*b* holding the zipper 114 to adjacent cloth 154*a*, 154*b* or other structure, positioning a new zipper and restitching. As noted above this procedure of replacing the entire zipper undesirably adds to the cost and delay of repair or maintenance, including the fact that typically the entire zipper would be replaced, even if only a single component had failed. Further, previous zipper structures typically were not repaired at a retail location, much less in the field.

Figure 5:
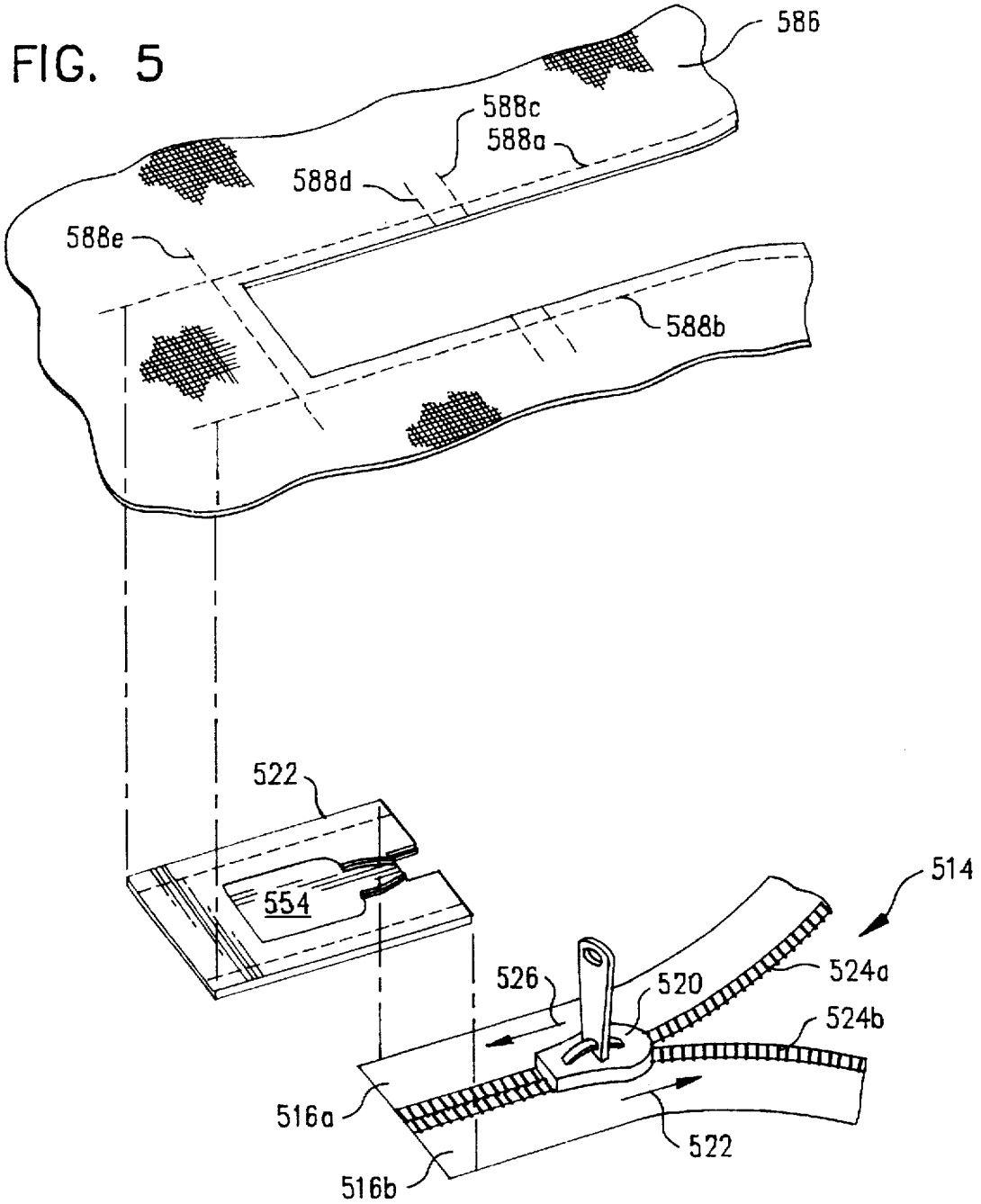
FIG. 5 is an exploded partial view of a zipper device according to an embodiment of the present invention.

FIG. 5 depicts an embodiment of the present invention which can be used to facilitate removal of a component such as the slider 220 (e.g., for replacement and/or repair). In the embodiment of FIG. 5, an endplate 552 is provided for use in conjunction with a zipper 514 which can be any of a number of types of zippers including a metal-toothed zipper, a plastic-toothed zipper (including a zipper whose teeth are formed from strips of plastic in a substantially helical shape) or other zippers of types known to those of skill in the art. The zipper 514, as depicted, includes first and second tapes 516*a*, 516*b* zipper teeth 524*a*, 524*b* and a slider 520. The end plate 552 may be fastened to the tape 516*a*, 516*b* in a number of fashions, including stitching 588*a*, 588*c*, 588*a*, 588*b*, heat tacking or welding, adhesives, crimping, hook and loop fasteners, or integral formation therewith. The end plate 552, in the depicted embodiment, includes a first door or other covering 554 which is movable or removable to provide a slider receiving area, as described more fully below. The end plate 552 may be made from a number of materials including plastics such as nylon, metals such as steel, aluminum, brass or the like, fabric, preferably stiffened or reinforced fabric, wood, ceramics, resins and/or reinforced materials such as composite or reinforced materials. The end plate 552 may be composed of 2 or more different materials such as a layered composite and/or may be provided of two or more different parts which are joined together e.g., be adhesives, brazing, welding, interlocking, latching, connections, and the like.

As depicted in FIG. 8A, in one embodiment, the door 554 has a main region 556 which, in the depicted embodiment, is integrally formed with a neck region 558 coupled to a tab-like stop member 562.

Although it is possible to provide the door 554 as an entirely separate piece which can be removed bodily, e.g., by a "snap out" mechanism that is resiliently engaged with the corresponding edges of plate 552, in the illustrated embodiment the door 554 is coupled to the plate 552 e.g., by a hinge connection along an edge 564, which may be a number of types of hinges including a pin hinge, or a living hinge (e.g., formed by scoring to facilitate bending of the end plate along the score line).

In the embodiment of FIG. 8A, a region 566 adjacent the receiving area 568 (FIG. 6B) is provided with guide lugs 542*a*, 542*b*. The guide lugs 542*a*, 542*b* are preferably sufficiently aligned with the teeth of the zipper 514 such as the teeth which are found in region 572, to permit easy engagement of the slider 520 with the teeth of the zipper 514 as the slider is moved from engagement with the guide lugs 542*a*, 542*b* (FIG. 6C) in the direction 522 away from the end plate 552, as discussed below. As depicted in FIG. 8C the lugs 542*a*, 542*b* can be provided with a generally rectangular cross section and preferably are configured to engage with the slider 520, for purposes to be described below. Unlike previous guide lugs, the guide lugs 242*a*, 242*b* depicted in this embodiment are not formed as part of the tape 216*a*, 216*b* but, rather, are preferably integrally formed with the end plate 552. Furthermore, these lugs 542*a*, 542*b* of the present invention are not configured to be moved with respect to one another but are held in a substantially (albeit, resiliently deflectable) permanent position with respect to one another. Additionally, in the depicted embodiment, neither of the lugs 542*a*, 542*b* is coupled to a keeper device. The lugs 542*a*, 542*b* will not be employed during normal use of the zipper, but typically, will be employed only when it is desired to move the slider 220 into a receiving area 568, e.g., for the purpose of removing the studs.

Figure 7:
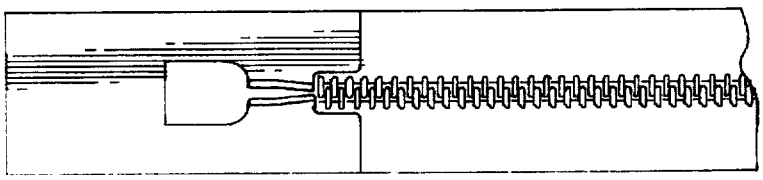
FIG. 7 is top plan view of the zipper according to an embodiment of the present invention.

In the depicted embodiment, the stop member 562 is positioned in a region 572 (FIG. 8B) defined by ears 574*a*, 574*b* of the end plate 552. As seen in the embodiment of FIG. 6B and FIG. 7, preferably the teeth of the zipper extend into or adjacent the region 572 defined by ears 574*a*, 574*b*.

Figure 6A:
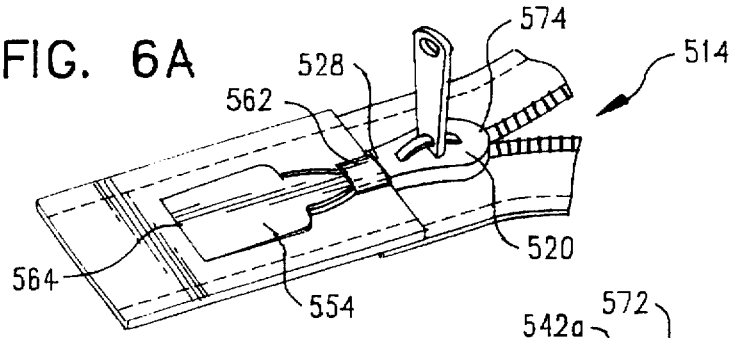
FIGS. 6A–6E are perspective views illustrating removal of a slider according to an embodiment of the present invention

During normal "non-maintenance" use, the slider 520 will be moved in the zipping or unzipping direction 522, 526 with the extent of motion of the unzipping direction 526 being limited by the stop member 562, as depicted in FIG. 6A. In practice, when it is desired to perform maintenance or repair, the door 554 is moved e.g., by rotating 672 about the hinge 564 (FIG. 6B). Because the door 554 includes or is coupled to the stop member 562, in the depicted embodiment, e.g., via neck portion 558, in the unzipping direction 526, when the door 554 is opened, the region 572 is exposed and the slider 520 may be moved into the open region 572 so that the slider 520 is aligned with the guide slugs 542*a*, 542*b*. Further movement in the unzipping direction 526 causes the slider 520 to move into the region of and engage with the guide lugs 542*a*, 542*b* as depicted in FIG. 6C. Yet further motion in the unzipping direction 526 will position the slider 520 off the guide lugs 542*a*, 542*b* and within the receiving area 568 as depicted in FIG. 6D. In the depicted embodiment, the slider 520 may then be moved away from the end plate 550 and out of the receiving area 568 by moving in a direction 582 perpendicular to the plane of the end plate 552, as depicted in FIG. 6E. Although FIG. 6E depicts movement of the slider 520 in a downward direction 582, slider may also be moved in an upward direction in the depicted embodiment.

Figure 6B:
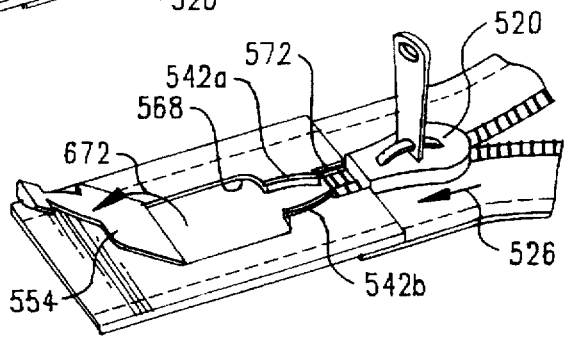
Figure 6C:
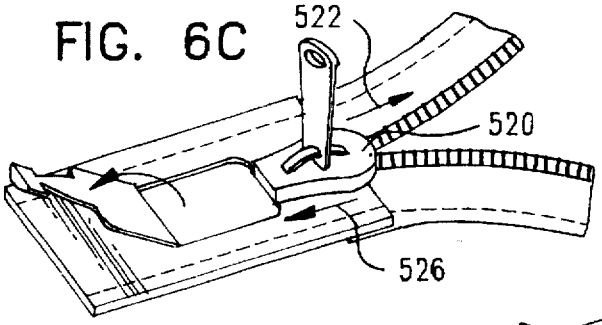
Figure 6D:
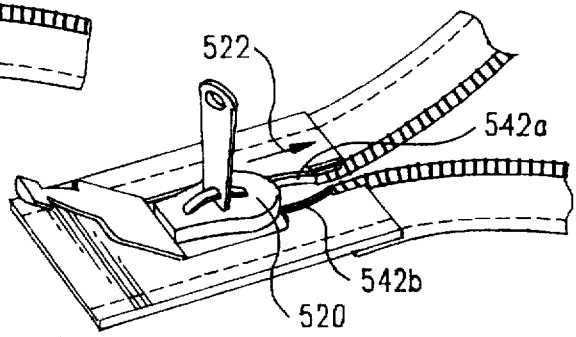
Figure 6E:
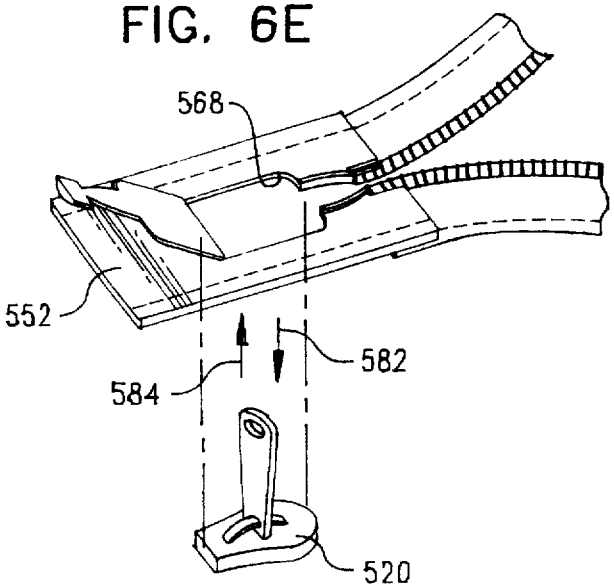

Insertion of a slider onto the zipper, e.g., following repair of the slider or for replacement or addition of a new slider, can be achieved by a process that substantially reverses the process depicted in FIGS. 6A–6E. In such a process with the door 554 in the open configuration, the slider 520 can be positioned adjacent to the plate 552, as shown in FIG. 6E, moved in a direction 584 into the receiving area 568, to assume the position depicted in FIG. 6D. When the slider 520 is in the position depicted in FIG. 6D, slider 520 will be substantially aligned or alignable with the guide slugs 542*a*, 542*b*. Movement of the slider 520 in a zipping direction 522 will move the slider 520 into engagement with and onto the guide lugs 542*a*, 542*b*, as depicted in FIG. 6C. Further movement of the slider 520 in a zipping direction 522 will position the slider 520 onto the tapes, so as to engage the teeth in such a manner as to permit zipping of the zipper device. Once the zipper 520 has moved beyond at least a portion of the open region 572, as depicted in FIG. 6B, the door 554 may, if desired, be closed or moved to the position as depicted in FIG. 6A, e.g., in order to provide a positive stop for the slider 520.

In light of the above description a number advantages of the present invention can be seen. The present invention provides a method and device for facilitating movement of the zipper slider off the zipper tape in such a manner that the slider (or a replacement or additional slider), can be easily reintroduced onto the tape. Preferably, the device and method allows the slider to be removed, e.g., for repair or replacement. The present invention provides this capability at a relatively low cost of manufacture and installation, particularly in cases in which the end plate 552 is formed from an inexpensive material such as plastic in an inexpensive manufacturing procedure such as extrusion or stamping and particularly in cases in which the end plate may be readily attached to the fabric or other material to be closed or opened by the zipper such as by stitching 588*a*–588*e*. The present invention provides for a manner in which separate components such as a slider can be easily replaced in the field, such as by an end user or at a facility other than a factory repair facility, such as at a retail facility. This may assist in avoiding shipping costs and delays involved in sending an entire apparatus containing the zipper (such as a tent) to a central repair facility. Furthermore, since slider replacement can be easily effected by an end user, the present invention is advantageous in that it makes it more feasible to provide for zipper closings and openings in devices which may find use in remote areas where maintenance or repair facilities are not readily accessible, such as on tents or other camping equipment which may be used in remote areas. For example, campers may readily replace a malfunctioning slider without having to cut short an excursion. The present invention provides end users an opportunity to remove a slider from a zipper device e.g., for security purposes to prevent unauthorized zipping or unzipping. Removal of a slider can be useful to remove the protrusion of the slider (in order to prevent snagging e.g. snagging of luggage during handling), to provide a more appealing appearance of a zipped or unzipped device and provides an opportunity for an end user to add or remove sliders from the zipper e.g. converting a one-slider zipper to a two-slider zipper and vice versa.

A number of variations and modifications of the present invention can be used. Although the present invention has been described in the context of zippers used in tents or other camping equipment, present invention can be used for any type of zipper application including zippers provided in clothing, equipment or other coverings, containers, or any of the other myriad uses of zippers. In one embodiment, the door may be provided with a locking device when it is desired to prevent unauthorized removal or insertion of the slider or other zipper component. Although present invention has been described in connection with a closed zipper environment, the present invention can also be used in connection with an open zipper environment. Although in the embodiment of FIG. 8A the main region 556 neck 558 and stop member 562 are integrally formed, it is possible to define these portions separately, i.e., non-integrally and/or to delete some or all of the door portions. For example, it is possible to delete all door portions if there is no need or desire to prevent the slider 520 from moving into the receiving area during normal use. For example, in one embodiment it may be desired to permit the user to routinely remove the slider as a security measure, to discourage the unauthorized unzipping or zipping of the zipper. Even when it is desired to prevent or discourage movement of the slider into the receiving area during normal use, this could be achieved by providing only a device such as stop member 562 (which might be movable bodily, by a hinge or otherwise) when it is desired to move the slider into the receiving area. Rather than providing a solid stop member 562, guarding against movement past the desired bottom location during normal use could be achieved via a number of expediencies such as resilient or movable tabs or teeth, a slideable latch and the like. Although it is currently contemplated that the present invention will find its freest and most popular use in connection with a closed environment such as a closed environment tent zipper as depicted in FIGS. 4A and 4B, it is believed that there is significant utility for the present invention in connection with an open environment zipper such as that of FIGS. 2A, 2B and 3 since, even in that environment, the slider 220 is normally constrained to remain adjacent to at least one of the tapes during normal use.

Although the depicted embodiment shows a single unitary door which includes a main region 556 covering the receiving area 568, a neck region and stop region, and other configurations are also possible. It is possible to provide an end plate which has no covering or door so that there is nothing to prevent the slider 520 from being moved into the receiving area 568. It is possible to provide an end plate which includes only a moveable stop member so that once the stop member is removed it is possible to move the slider 528 into the receiving area 568. It is possible to provide for a separate removable stop member 562 and main region 554. Rather than providing a stop member 562 which snaps into an open area 572 as depicted in FIGS. 5–8, movement of the slider 520 may be limited by other devices such as tab or door which may be held in place or released e.g. by a snap mechanism, hook and loop attachment and the like. Movement of the slider may be limited by resilient stops such as teeth or tabs such that the slider 520 is stopped by such device when normal zipping or unzipping force is used but such that the slider may be moved toward the receiving area 568 by exertion of greater force, such as force sufficient to overcome a resilient stop device. Although it is believed that providing the door 554 as a hinged device is useful in preventing losing or misplacing the door, it is also possible to provide the door or other components as fully separate and removable pieces. Although the door, or components thereof, are depicted as being held in the closed position by resilient means such as resilient tab and slot edges as shown in FIG. 8, or resilient edges such as shown in FIG. 8C, other retaining devices can be used such as snaps, hook and loop devices, latches, sliding tabs and the like. Rather than providing a door which is opened by a hinged movement, the door may also be opened by a sliding movement, such as providing for tracks or other guides for moving the door and the like. Although the lugs 542*a*, 542*b* have been described in connection with an embodiment in which they are formed integrally with the plate 552, it is also possible to regard the lugs 542*a*, 542*b* as separate components which may be attached or coupled to the end plate 552 or otherwise held in a position to achieve guidance of the slider 220 into the receiving area 568. For example, in one embodiment, it may be possible to use two tapes such as tape 216*a* depicted in FIG. 2A with the teeth configured to engage with one another, and position the lugs 242*a* thereof adjacent a receiving area 568 e.g., by sewing or otherwise coupling the tapes 216*a* to an end plate which defines a receiving area 568.

Although FIGS. 5–6 depict a configuration in which the end plate 552 is positioned adjacent the first end of the tapes 516*a*, 516*b* so that when the rear wing 528*a* is abutting the stop member 562 the zipper 514 is in the unzipped condition, it is also possible to position a plate 552 of the second end of the zipper e.g. such that the front wing 574 of the slider 520 can abut the stop member 562 of the end plate 552, e.g., when the zipper is in the closed configuration. If desired, an end plate 552 may be placed at each end of the zipper. Although portions of the description refer to movement of the zipper in a "sliding" or "unsliding" direction, this is done for the sake of convenience of description with respect to the depicted embodiments and those of skill in the art will understand how present invention can be used regardless of whether the zipper device is in a zipped or an unzipped state when the slider is positioned adjacent the end plate. Although FIGS. 5–8B depict an end plate in which the slider may be removed in a direction parallel to the plane of the end plate, other configurations were also possible such as a configuration in which the receiving area 568 can open onto a lateral opening for removal of a slider in a direction 591*a*, 591*b* substantially parallel to the plane of the end plate. Although in the depicted embodiments the device for accommodating maintenance or repair is substantially plane- or plate-like, the device can also have other shapes such as substantially curved, rounded, oblong, disc-like, sphere-like and so forth. Although in the depicted embodiment the end plate is configured so that the slider 552 may be removed from the holding area or receiving area 568, the device can be used in situations where the slider is not removed from the holding area or the receiving area 568 such as when it is desired to move the slider away from the teeth e.g., for maintenance or repair of the teeth or tape portion of the zipper. If desired the receiving area 568 may be configured to hold and/or retain the slider therein rather than (or in addition to) facilitating removal of the slider.

In another embodiment, slider removal can be provided by modifying a configuration similar to that depicted in FIGS. 2A and 2B to permit removal or disengagement of the keeper 218 from the lugs 242*a*, 242*b*. For example lugs 242*a*, 242*b* may be latchably engagable and disengagable with keeper 218, and, may be also engagable with one another, if desired.

Although the present invention has been defined by way of certain variations and modifications other variations and modifications also can be used, the invention being defined by the following claims:

What is claimed is:

1. A zipper apparatus, comprising:

first and second tapes, each bearing a plurality of engagable teeth, said tapes defining a first and a second end;

a slider configured to engage said teeth;

a plate having a first edge adjacent said first end, and interior edges defining a receiving area, communicating with said first edge, sized and shaped to accommodate said slider; and a door movable from a first position at least partially covering said receiving area, to a second position substantially uncovering said receiving area.

2. A zipper apparatus as claimed in claim 1 further comprising means for retaining said door in said first position.

3. A zipper apparatus as claimed in claim 1, wherein said door includes at least a first edge resiliently engagable with an edge of said receiving area for retaining said door in said first position.

4. A zipper apparatus, as claimed in claim 1 wherein said receiving area communicates with said edge by a slot.

5. A zipper apparatus, as claimed in claim 4 wherein said door includes a region for covering said slot.

6. A zipper apparatus, as claimed in claim 1 wherein said door is coupled to said plate by a hinge.

7. A zipper apparatus, as claimed in claim 6 wherein said hinge is a living hinge.

8. A zipper apparatus, as claimed in claim 1 wherein said door is coupled to a stop member movable from a first position blocking movement of said slider in a first direction, to a second position permitting movement of said slider toward said receiving area.

9. A zipper apparatus as claimed in claim 1 further comprising means for limiting movement of said slider along a path towards said receiving area.

10. A zipper apparatus, as claimed in claim 1, further comprising:

a stop movable from a first position blocking movement of said slider in a first direction, to a second position permitting movement of said slider toward said receiving area.

11. A zipper apparatus as claimed in claim 10 wherein said stop is positioned in a first region adjacent said first edge.

12. A zipper apparatus, as claimed in claim 1, further comprising:

at least a first guide lug engagable with said slider and positioned such that said slider will substantially align with said teeth for engagement therewith when said slider is moved from said receiving area toward said tapes.

13. Apparatus, usable as a terminal region for a zipper having a zipper slider, and first and second sets of zipper teeth, the apparatus comprising:

a plate defining a receiving area sized and shaped to receive said zipper slider and at least a first guide lug, sized and shaped to at least partially engage said slider, said guide lug extending between said receiving area and a first edge of said plate, said guide lug being substantially alignable with at least one of said sets of zipper teeth.

14. A tent, comprising:

at least a first wall of said tent having an opening which can be at least partially closed by at least a first zipper having a zipper slider, and first and second sets of zipper teeth;

a plate, adjacent an end of said first zipper, defining a receiving area sized and shaped to receive said zipper slider and at least a first guide lug, sized and shaped to at least partially engage said slider, said guide lug extending between said receiving area and a first edge of said plate, said guide lug being substantially alignable with at least one of said sets of zipper teeth.

15. A method for removing a zipper slider from a zipper, the zipper having first and second tapes, each bearing a plurality of engagable teeth, said tapes defining a first end and a second end, the slider configured to engage said teeth, the method comprising:

providing a plate having a first edge adjacent said first end, and interior edges defining a receiving area, communicating with said first edge, sized and shaped to accommodate said slider;

moving said slider from engagement with said teeth into said receiving area; and removing said slider from said receiving area.

16. A zipper apparatus comprising:

first and second tapes, each bearing a plurality of engagable teeth, said tapes defining a first end and a second end;

a slider configured to engage said teeth;

a plate, with a first thickness, stitched to at least a portion of said zipper tapes, having a first edge adjacent said first end, and interior edges defining a receiving area, communicating with said first edge, said receiving area sized and shaped to accommodate said slider and defining a first receiving area edge, said plate having first and second ears defining an open region adjacent said first edge, receiving said first ends of said first and second tapes therein, said plate having an open neck region communicating between said receiving area and said open region, said neck region defining first and second neck edges;

first and second lugs having a thickness greater than the thickness of the plate, and positioned adjacent and substantially parallel to said neck edges, said first and second lugs having first and second lug ends substantially aligned with the teeth of said first ends of said first and second tapes;

a door configured to cover said receiving area, said neck region and said open area, and coupled to said plate by a living hinge along said first receiving area edge, said door held in a first position substantially covering said receiving area, said neck region and said open area by resilient engagement of the edge of said door with at least some edges of said receiving area, said neck region and said open area, said door movable to an open configuration by pivoting about an axis defined by said living hinge to substantially uncover said receiving area, said neck region and said open area.

* * * * *